US007568362B2

(12) United States Patent
Oas

(10) Patent No.: US 7,568,362 B2
(45) Date of Patent: Aug. 4, 2009

(54) BEAN BAG HOLDER TO BE USED TO HOLD A CAN OR BOTTLE

(75) Inventor: Daniel Oas, Irwindale, CA (US)

(73) Assignee: Calibre International, LLC, Irwindale, CA (US)

( * ) Notice: Subject to any disclaimer, the term of this patent is extended or adjusted under 35 U.S.C. 154(b) by 373 days.

(21) Appl. No.: 11/581,875

(22) Filed: Oct. 16, 2006

(65) Prior Publication Data

US 2008/0087786 A1 Apr. 17, 2008

(51) Int. Cl.
*F25D 3/08* (2006.01)

(52) U.S. Cl. ..... 62/457.3; 62/457.5

(58) Field of Classification Search ..... 62/457.1, 62/457.3, 457.5, 371, 530
See application file for complete search history.

(56) References Cited

U.S. PATENT DOCUMENTS

| | | | | |
|---|---|---|---|---|
| 3,028,702 | A | 4/1962 | Cyr | |
| 4,163,374 | A * | 8/1979 | Moore et al. | 62/457.4 |
| 4,269,654 | A * | 5/1981 | Deckert et al. | 438/756 |
| 4,788,916 | A | 12/1988 | Saxton | |
| 4,809,938 | A | 3/1989 | Skinner | |
| 4,889,302 | A | 12/1989 | Tucker | |
| 4,964,600 | A * | 10/1990 | Lee | 248/146 |
| 5,791,435 | A | 8/1998 | Garnett | |
| 6,581,888 | B1 | 6/2003 | Castillo | |
| 6,758,363 | B2 * | 7/2004 | Stokes | 220/592.15 |
| D493,674 | S | 8/2004 | Lowe | |
| D498,392 | S | 11/2004 | Lowe | |
| D504,285 | S | 4/2005 | Lowe | |
| 7,117,690 | B1 * | 10/2006 | Dunn et al. | 62/457.1 |

* cited by examiner

*Primary Examiner*—Melvin Jones
(74) *Attorney, Agent, or Firm*—Thomas I. Rozsa

(57) ABSTRACT

The present invention is a take-apart bean bag holder for carrying a beverage container such as a can. The bean bag holder is comprised of a container holder and an additional exterior double layer bag. The container holder is comprised of a top ring cover, a container, and a bottom planar ring attachment aligned in series. The exterior double layer bag is made of flexible material, and partially filled with granules such as beans or sand to give the container a squeezable feel when held in the hand. The bag is detachably attached to an exterior surface of the container holder with the location of the attachment shielded by the top ring cover. If the granules are made of heat or cold retaining granules, then the bean bag holder can be placed in a microwave to heat the granules to retain the contents of the can in a heated condition, or placed in a freezer to retain the contents of the can in the cold condition.

16 Claims, 5 Drawing Sheets

BEAN BAG HOLDER TO BE USED TO HOLD A CAN OR BOTTLE

BACKGROUND OF THE INVENTION

1. Field of the Invention

The present invention is related to a container for holding a can or a bottle.

2. Description of the Prior Art

In general, containers for holding a can or a bottle are known in the prior art. The following 10 patents and published patent applications are the closest prior art references which are related to the present invention.

1. U.S. Pat. No. 3,028,702 issued to Napoleon J. St. Cyr on Apr. 10, 1962 for "Nontipping Drinking-Glass Coaster" (hereafter the "Cyr Patent");

2. U.S. Pat. No. 4,788,916 issued to Nancy Saxton on Dec. 6, 1988 for "Cushion Pouch Tray" (hereafter the "Saxton Patent");

3. U.S. Pat. No. 4,809,938 issued to Sara J. Skinner et al. on Mar. 7, 1989 for "Baby Bottle Holder" (hereafter the "Skinner Patent");

4. U.S. Pat. No. 4,889,302 issued to Dalton R. Tucker on Dec. 26, 1989 for "Drinking Container Holder" (hereafter the "Tucker Patent");

5. U.S. Pat. No. 5,791,435 issued to William Garnett and assigned to Jacob's Ladder Bases Ltd. on Aug. 11, 1998 for "Ladder Etc. Support" (hereafter the "Garnett Patent");

6. U.S. Pat. No. 4,964,600 issued to San F. Lee on Oct. 23, 1990 for "Insulated Cup Holder With Flexible Base Member" (hereafter the "Lee Patent");

7. U.S. Pat. No. 6,581,888 issued to Kenneth Antonio Castillo on Jun. 24, 2003 for "Irregular-Surface Glass Holder" (hereafter the "Castillo Patent");

8. U.S. Design Pat. No. D493,674 issued to Graham C. Lowe on Aug. 3, 2004 for "Beverage Can Cooler" (hereafter the "674 Lowe Design Patent");

9. U.S. Design Pat. No. D498,392 issued to Graham C. Lowe on Nov. 16, 2004 for "Beverage Can Cooler" (hereafter the "392 Lowe Design Patent");

10. U.S. Design Pat. No. D504,285 issued to Graham C. Lowe on Apr. 26, 2005 for "Beverage Can Cooler" (hereafter the "285 Lowe Design Patent").

The Cyr Patent discloses a coaster for retaining a glass. The novel feature is that the coaster contains a multiplicity of weighted pellets 34 with an outer sack 26 which contains a section for retaining a glass. This has the ability so as to enable the bottom of the coaster to conform to any shape such as the arcuate shape of an armchair as illustrated in FIG. 3 so that the coaster can be placed while retaining the glass of liquid in any position and then can be retained in a stable manner. This discloses the concept of having a multiplicity of weighted pellets on the base of the coaster for the purpose of enabling the base to conform to any shape desired but does not have the entire coaster filled with the bean bag type material. The pellets are weighed to give the structure stability.

The Saxton Patent which issued in 1988 discloses a cushion pouch tray which supports a service tray 11 supported on a pouch 12. The tray assembly 10 includes a limp cushion or pillow 13 best illustrated in FIG. 2 which is partially filled with very light weight granules or pellets. The pouch can be deformed in any manner because of the flexible pellets to support the tray.

The Skinner Patent discloses a baby bottle holder which enables the bottle to be retained in an inclined position to be able to feed the baby.

The Tucker Patent discloses a receptacle for retaining a liquid containing device. In this case, the receptacle has the ability to have its bladder filled with liquid and thereafter the liquid may be heated in a microwave or frozen in a refrigerator to keep the liquid contained within the beverage container hot or cold. Thick, mushy substance 22, comprised of fibrous material 17 swollen in the water or other liquid permits holder 1 to be placed in a freezer to freeze the substance thereafter to chill the contents of the drinking container received therein or alternatively replaced in the microwave oven to heat the substance thereafter to heat the material or a cup or other drinking container received therein. Therefore, this device discloses the concept of having the mushy material as it is called which can be heated or frozen and has the bladder filled with liquid.

The Garnett Patent discloses a ladder support which consists of a bag 10 which is filled with sharp sand 11 as illustrated in FIG. 3. This flexible structure is designed to retain a ladder.

The Lee Patent discloses an insulated cup holder which is designed to basically retain a cup as illustrated in FIG. 1 and which has a multiplicity of granular material 32 best illustrated in FIGS. 8 and 9. The function is to provide an insulating means and it does not say that its function is to enable it to feel like a bean bag.

The Castillo Patent is an irregular surface glass holder which basically has a base 12 as illustrated in FIG. 2 which is filled with sand 16, granules 18 or a liquid 20 that is flexible enough to adapt to any irregular shape of surface so that the base can form to the surface to keep the glass in a vertically oriented condition so it may retain liquid. This base can be retained in a single compartment as shown in FIG. 4 or in a plurality of smaller compartments as shown in FIG. 2. The concept here is to provide a flexible base so that any shape rough surface can be used to support the glass in the vertical condition because of the flexible base which conforms to the shape of the unusual surface.

The 674 Lowe Patent discloses a design patent for a beverage can cooler.

The 392 Lowe Patent is also a design patent for a different shaped beverage can cooler which once again shows the shape but does not show any interior bean bag like material within the beverage container holder.

The 285 Lowe Patent is also a container for a beverage container with a different shape which once again supports the can within the container but does not talk about having the beverage container holder being a flexible material in the formable bean bag like material.

There is a significant need to significantly improve a container holder for a can or a bottle.

SUMMARY OF THE INVENTION

The present invention is a take-apart bean bag holder for carrying a beverage container such as a can. The bean bag holder is comprised of a container holder and an additional exterior double layer bag. The container holder is comprised of a top ring cover, a container, and a bottom planar ring attachment aligned in series. The exterior double layer bag is made of flexible material, and partially filled with granules such as beans or sand to give the container a squeezable feel when held in the hand. The bag is detachably attached to an exterior surface of the container holder with the location of the attachment shielded by the top ring cover. If the granules are made of heat or cold retaining granules, then the bean bag holder can be placed in a microwave to heat the granules to retain the contents of the can in a heated condition, or placed in a freezer to retain the contents of the can in the cold condition.

It has been discovered, according to the present invention, that if a container of the bean bag holder comprises a transverse ring which is located below the top of the container, then a double layer bag can detachably and securely retained on the container holder through an elastic attachment means retained on the ring.

It has also been discovered, according to the present invention, that if there is an air gap between the bottom of the container and a bottom ring attached wich is attached onto the bottom of the container, then the present invention bean bean bag holder will have a good heat insulation at the bottom of the holder to significantly reduce heat transfer between the bottom of the bean bag holder and the surface onto which it is placed.

It has been further discovered, according to the present invention, that if the exterior double layer bag is made of flexible material and filled with granular particles, it will provide a squeezable and comfortable feel when the container is held in the hand of a user.

It has been further additional discovered, according to the present invention, that if the bean bag hold can be disassembled into separate parts, the present invention bean bag holder can be conveniently washed.

It is an object of the present invention to provide a container to retain a beverage can which has an interior chamber to retain the can and exterior surface onto which a double layer fabric bag can be retained, the double layer fabric having granules between the two walls of the double layer bag so the container will have a squeezable feel when held.

It is also an object of the present invention to provide a ring cover member which is attached onto the container so that after the double layer bean bag is retained thereon, then the location where the double layer bean bag is retained is shielded by the ring cover.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a bean bag holder for carrying a container which has a liquid retained inside of the container. The primary purpose of the present invention is to provide a comfortable squeezable feel to the bean bag holder. In addition, others features of the present invention are to keep the beverage in the can hot or cold for a period of time. The lower bean bag surface also enables the holder to be securely placed on an uneven surface.

Figure 1:
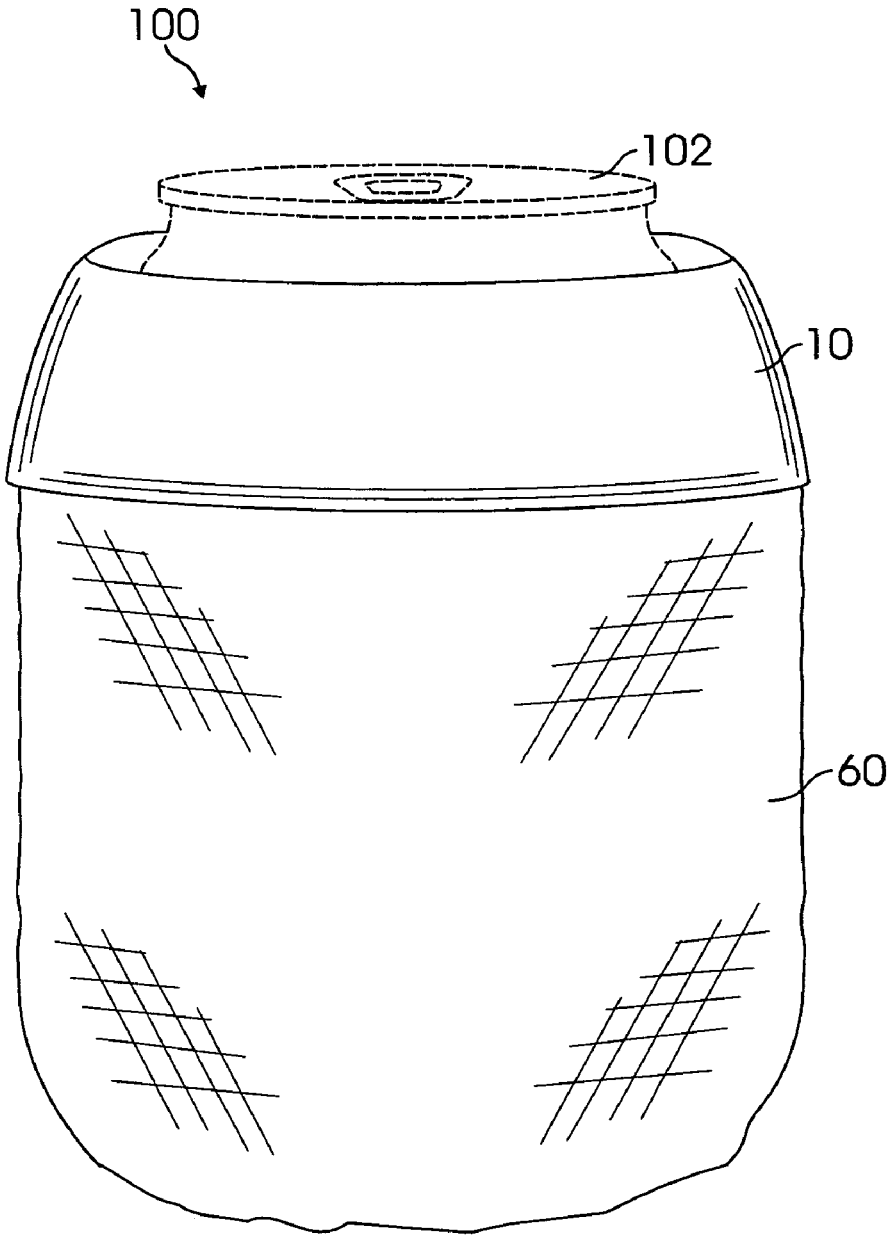
FIG. 1 is a perspective view of the present invention bean bag holder for use to hold a canned drink.

Referring to FIG. 1 there is illustrated the present invention bean bag holder 100, which includes an additional exterior double layer bean bag 60 to surround a container holder. As illustrated, a can 102 is placed inside of the bean bag holder through a top ring cover 10 of the bean bag holder 100.

Figure 2A:
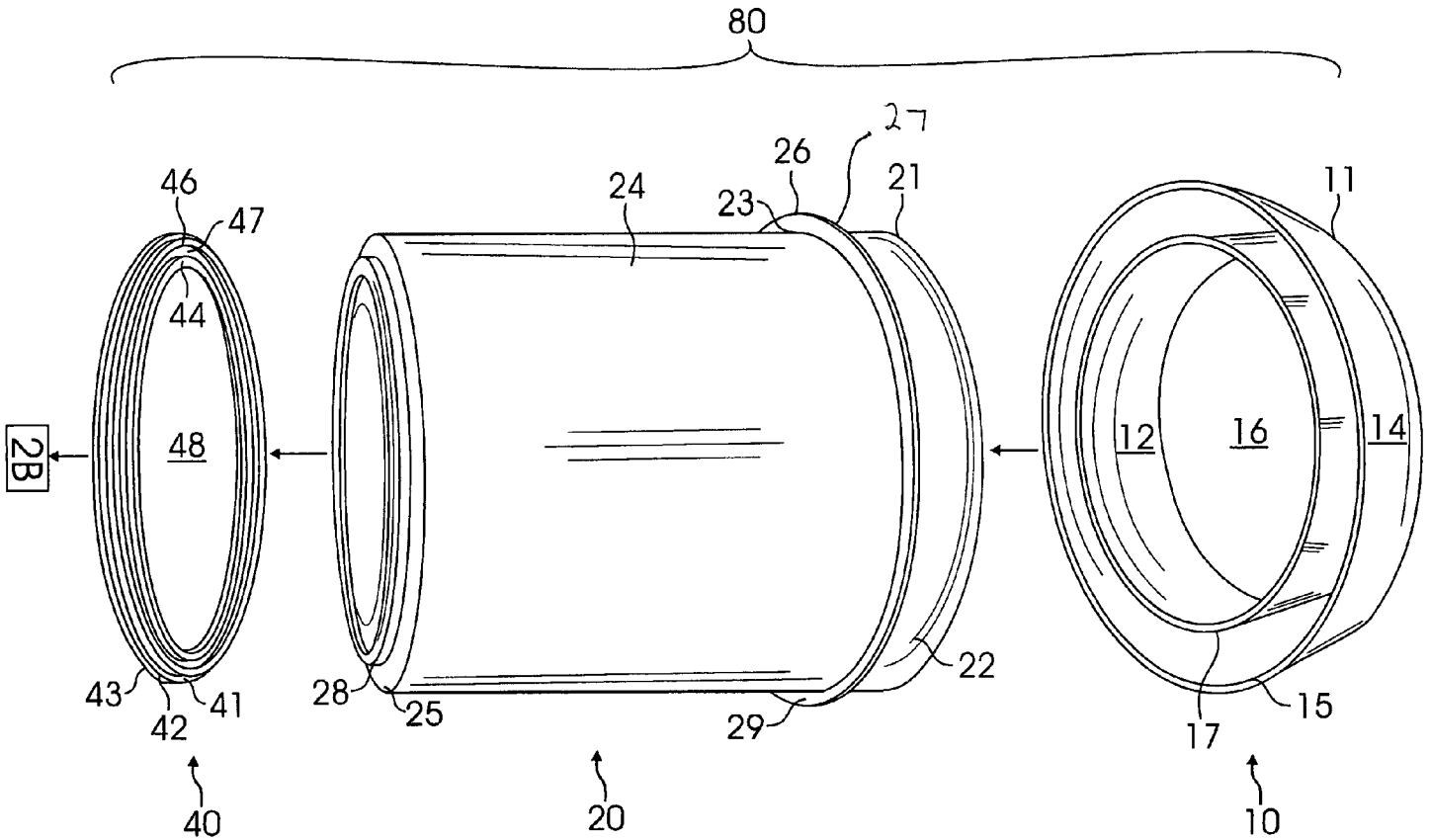
FIG. 2A is a perspective exploded view of the present invention bean bag holder, which shows a container holder comprising a top ring cover, a container, and a bottom ring attachment.
Figure 2B:
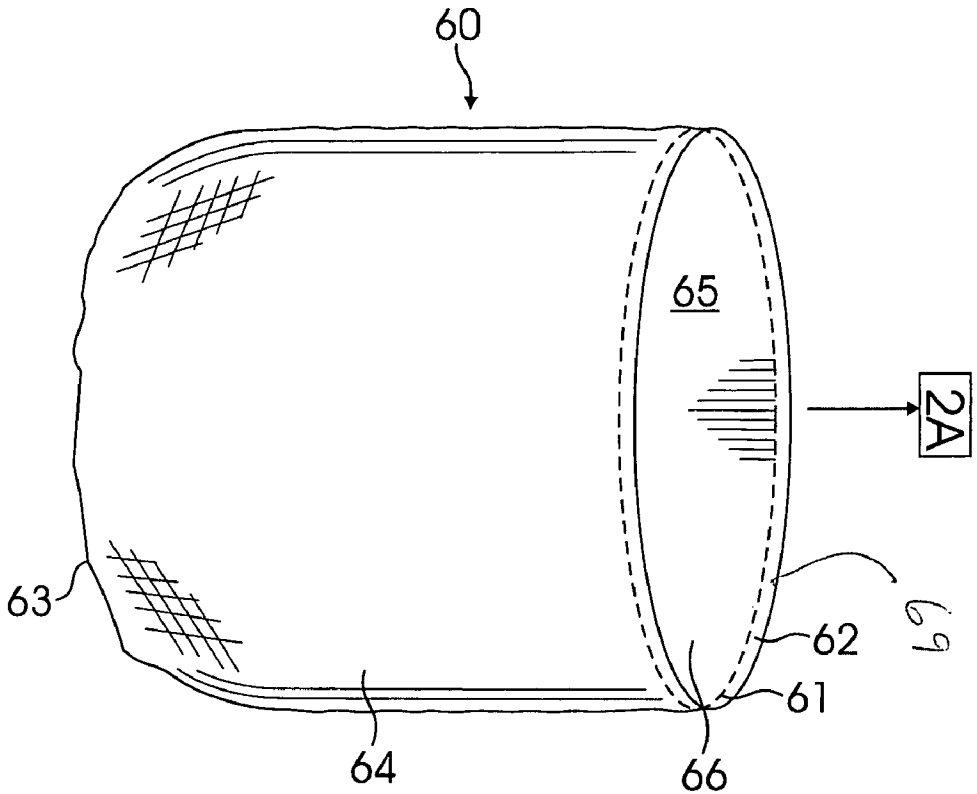
FIG. 2B is a portion of the perspective exploded view of the present invention bean bag holder, which shows a double layer bag.

A preferred embodiment of the present invention bean bag holder 100 as illustrated in the exploded view of FIGS. 2A and 2B is shown to comprise a container holder 80 and the exterior double layer bean bag 60. The container holder 80 is comprised of the top ring cover 10, a container 20, and a bottom planar ring attachment 40 all aligned in series. As illustrated, the top ring cover 10 has a circular inner cylindrical wall 12 which extends to a bottom circumference 17 and outer curved circular wall 14 which extends downwardly and outwardly at an angle from top circumference 11 to a bottom circumference 15. The circular inner cylindrical wall 12 and the outer curved wall 14 are joined at the top circumference 11 to form a round opening 16 of the bean bag holder 100.

The container 20 is generally an open ended cylindrical structure, comprising a first smaller cylindrical section 22 and a second larger cylindrical section 24 of the container holder, wherein the first section 22 has a slightly larger diameter than the second section 24. The first cylindrical section 22 is a cylinder having a top round opening 21 which extends to intercept a transverse outer ring 26 having a respective first and second surface 27 and 29. The transverse outer ring 26 is connected to a top 23 of the second cylindrical section 24 which has a closed flat bottom 25. As illustrated, a short circular wall 28 is vertically affixed to the bottom 25 of the container holder 20.

The bottom planar ring attachment 40 is comprised of a planar ring 42 having first and second horizontal surfaces 41 and 43 which surround a central round opening 48, and first and second short height circular walls 44 and 46 which are vertically affixed onto the first horizontal surface 41 of the ring 42. The first and second short height walls 44 and 46 are further illustrated to be concentric and separated by a gap 47. It will be appreciated that the gap 47 matches a thickness of the circular wall 28 on the bottom 25 of the container holder 20.

The double layer bean bag 60 with a top opening 65 is comprised of a top hem 62 with stitches 61, an outer bag 64 with a bottom 63, and inner bag 66. The double layer bag 60 can also be considered to have an outer wall 64 and an inner wall 66. It will be appreciated that there is an elastic means 69 such as a rubber band or elastic band placed within the top hem 62 so that the double layer bean bag 60 can be securely affixed to the outer surface of the container holder 20, wherein the top hem 62 of the bag 60 is detachably attached onto the top of the outer transverse ring 26 of the container 20. The double layer bean bag is made of flexible materials. In a preferred embodiment it is made of natural or synthetic fabric.

Figure 3:
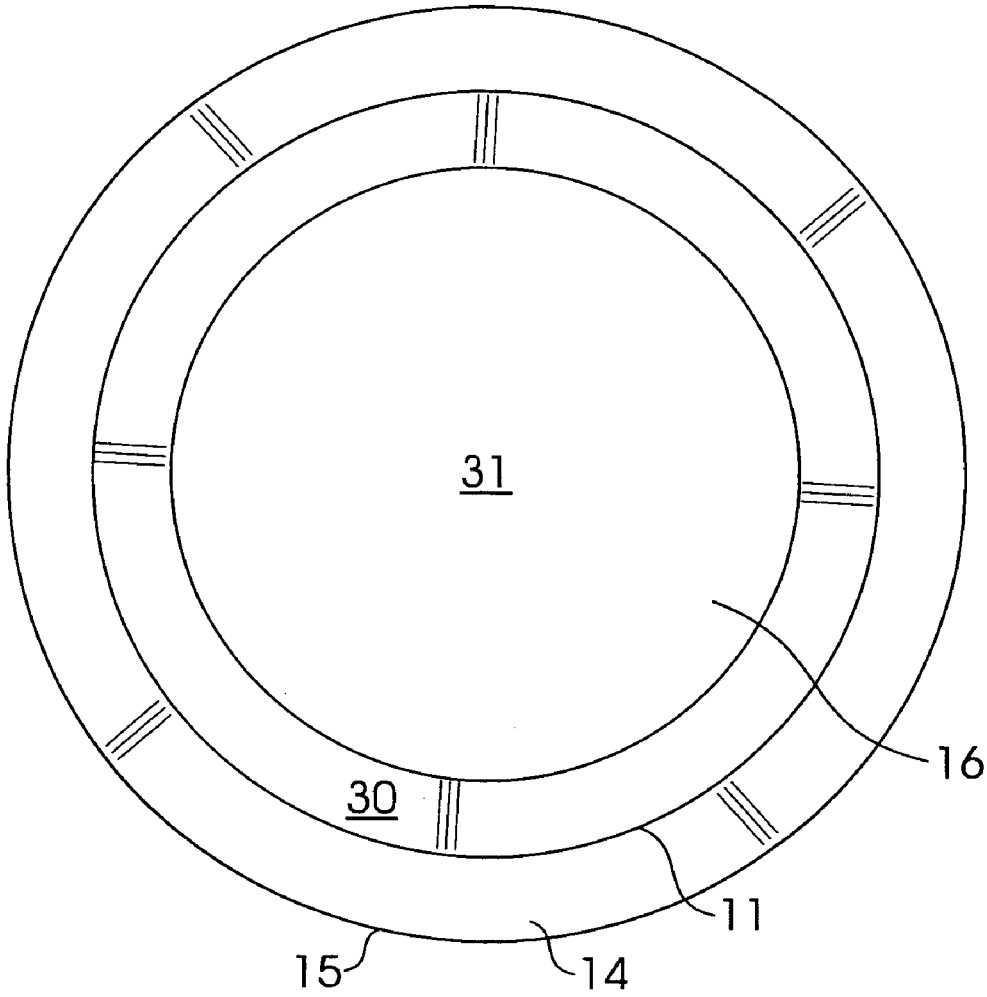
FIG. 3 is a top view of the present invention bean bag holder.

FIG. 3 illustrates a top plan view of the preferred embodiment of the bean bag holder 100. It will be appreciated that from the top view the outer curved wall 14 of the top ring cover 10 shields the exterior double layer bean bag 60, therefore, only the outer curved wall 14 of the top ring cover 10 and inner surface of the container 20 are visible through FIG. 3. As illustrated, the visible structural features in FIG. 3 are the circular outer curved surface 14 bounded with the top and bottom circumference 11 and 15, the round opening 16 from the top ring cover 10, an inner cylindrical surface 30 and inner bottom surface 31 of the second cylindrical section 24 of the container 20. Although the present invention bean bag 100 is illustrated through FIGS. 1-3 to be a preferred round shaped embodiment, it will be appreciated that any type of shape of the bean bag holders will be effective, and within the spirit and scope of the present invention.

Figure 4:
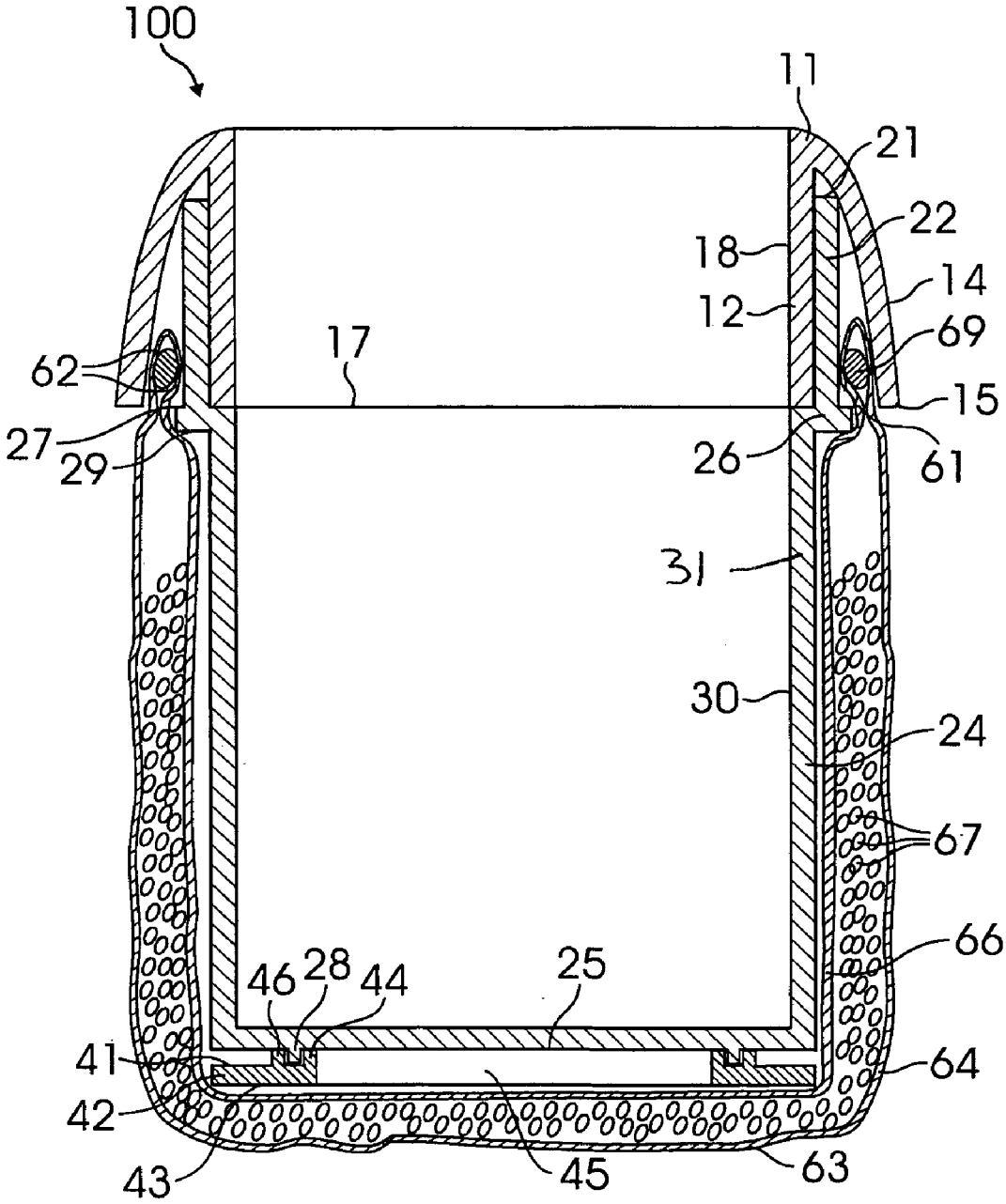
FIG. 4 is a cross-sectional view of the present invention bean bag holder.

The bean bag holder 100 is assembled in accordance with the illustration of the cross-sectional view of FIG. 4. The top ring cover 10 is placed on the round top 21 of the container 20, wherein the top circumference 11 of the top ring cover 10 matches the top 21 of the container 20, and the inner cylindrical wall 12 press fits into the interior of the first cylindrical section 22, which results in the an inner surface 18 of the inner cylindrical wall 12 being aligned with the inner surface 30 of wall 31 of the second cylindrical section 24 of the container 20. The bottom planar ring attachment 40 is affixed to the bottom 25 of the container 20 by insertion of the short height circular wall 28 of the container holder 20 into the gap 47 of the bottom planar ring attachment 40. A connection of the short height vertical walls 44, 46 and 28 creates an air gap 45 between the bottom 25 of the holder 20 and the second horizontal surface 43 of the bottom planar ring attachment 40. The double layer beam bag 60 is attached to the container holder 80, wherein the top opening 65 of the bag is elastically opened, and the bottom 25 of the container 20 with the bottom planar ring attachment 40 of the container holder 80 is placed into the opening 65 of the bag, and then the top hem 62 is placed to elastically surround the top of the transverse ring 26 through a contracting force from the rubber band or elastic member 69 which is placed inside of the hem 62. The double layer bean bag 60 has an interior wall 66 and an exterior wall 64 with a space between the walls to retain and be filled with particles 67, such as beans, granules, or sand.

The present invention can be embodied in various sizes, shapes, and dimensions. Therefore, it will be appreciated that a connection of the container to the bottom ring attachment for forming the air gap is not limited to the insertion among the short height circular walls. Alternatively, the connection can be applied in accordance with other mechanical structures of male and female inserts, wherein multiple male inserts are vertically located on the bottom ring attachment, and many female inserts having the same number as the male inserts are vertically affixed to the bottom of the container.

It will be appreciated that the bean bag holder 100 of the present invention has various useful functions in accordance with its unique structural features. Most importantly, the beans or particles or sand 67 between the walls 64 and 66 of the bean bag 60 can provide a squeezable feel to a user since the beans or granules 67 enable the surface to been soft and squishy.

In addition, the bean bag holder 100 can be used for keeping the contents inside of the container such as the beverage cold or hot for a period of time due if the filled particles 67, such as the beans, granules, and sands are made of material that enables can be heated or frozen. reservoir. For this purpose, the bean bag holder 100 can be placed into a freezer to freeze the filled particles 67 inside of the double layer bean bag 60, and then to chill the contents of the container received therein. Alternatively, the bean bag holder can be placed in a microwave oven to heat the filled substance 67, thereafter to heat the contents of the container received therein. In addition, the air gap 45 on the bottom 25 of the container holder provides a good heat insulation to effectively block heat transfer between the bean bag holder 100 and the surface on which it is placed.

Since the walls 64 and 66 also extend to the bottom of the bean bag 60, the beans or granules 67 can also be located in the area of the bottom of the bean bag 60 so that its bottom surface 63 can be flexible and conform to any shape surface on which the bean bag holder 60 is placed.

In addition, the present invention bean bag 100 can be conveniently machine washed after it is disassembled into the separate parts shown in FIG. 2 so that the parts can be placed into a dish washing machine to be cleaned.

Defined in detail, the present invention is a container holder comprising: (a) a top ring cover, a container, and a bottom ring attachment, the top ring cover having a top circumference with circular inner cylindrical wall extending to a bottom interior circumference and an outer curved declining outwardly extending wall extending from the top circumference to a bottom exterior circumference, the circular inner cylindrical wall and outer curved wall joined at a top circumference to form a round opening of the top ring cover; (b) the container is a generally a cylindrically shaped apparatus having a first cylindrical section and a second cylindrical section, the first cylindrical section having a top round opening extending to a transverse outer ring which connects to a top of the second cylindrical section which has a closed flat bottom, with a short height circular wall vertically affixed to an outer side of the bottom of the container; (c) the bottom planar ring attachment having a planar ring containing a central round opening, and a first and second short height circular wall which are vertically affixed onto the planar ring, the first and second short height wall are concentric and separated by a gap which matches a thickness of the circular wall on the bottom of the container; (d) the top ring cover covers the top round opening of the container, the bottom planar ring attachment is affixed to the bottom of the container by insertion of the short height circular wall of the container into the gap of the bottom planar ring attachment, which creates an air gap between the bottom of the container and a bottom surface of the bottom planar ring attachment; (e) a double layer bag with a top opening having a top hem containing an elastic means, an outer wall and an inner wall with a gap between the walls, the double layer bag securely affixed to an outer side of the container by having the top hem of the bag detachably attached onto the top of the outer transverse ring of the container and retained thereon by the elastic means, the outer curved wall of the top ring cover shielding the top hem at the location where the double layer bag is retained on the outer transverse ring; (f) the top ring cover press fit onto the container so that the circular inner cylindrical wall is press fit within the first cylindrical section of the container; (g) a multiplicity of granules retained within the gap between the outer and inner walls of the double layer bag to provide a squeezable feel to the double layer bag; and (h) the combination of the top ring cover and container being sized to retain a beverage container therein.

Defined more broadly, the present invention is a container holder comprising: (a) a top ring cover and a container, the top ring cover having a top circumference with circular inner cylindrical wall extending to a bottom interior circumference and an outer curved declining outwardly extending wall extending from the top circumference to a bottom exterior circumference, the circular inner cylindrical wall and outer curved wall joined at a top circumference to form a round opening of the top ring cover; (b) the container is a generally a cylindrically shaped apparatus having a first cylindrical section with a wall and a second cylindrical section with a wall and with a smaller diameter than the first cylindrical, the first cylindrical section having a top round opening extending to a transverse outer ring which connects to a top of the second cylindrical section which has a closed flat bottom; (c) the top ring cover covers the top round opening of the container by having the top ring cover press fit onto the container so that the circular inner cylindrical wall is press fit within the wall of first cylindrical section of the container and is aligned with the wall of the second cylindrical section; (d) a double layer bag with a top opening having a top hem containing an elastic means, an outer wall and an inner wall with a gap between the walls, the double layer bag securely affixed to an outer side of the container by having the top hem of the bag detachably attached onto the top of the outer transverse ring of the container and retained thereon by the elastic means, the outer curved wall of the top ring cover shielding the top hem at the location where the double layer bag is retained on the outer transverse ring; (e) a multiplicity of granules retained within the gap between the outer and inner walls of the double layer bag to provide a squeezable feel to the double layer bag; and (f) the combination of the top ring cover and container being sized to retain a beverage container therein.

Defined even more broadly, the present invention is a container holder comprising: (a) a top ring cover and a container, the top ring cover having an interior wall and an exterior wall both joined at a top circumference to form a round opening of the top ring cover; (b) the container is a generally cylindrically shaped apparatus having a first cylindrical section and a second cylindrical section, the first cylindrical section having a top round opening extending to a transverse outer ring which connects to a top of the second cylindrical section which has a closed flat bottom; (c) the top ring cover covers the top round opening of the container by having the top ring cover press fit onto the container so that the interior wall is press fit within the first cylindrical section of the container; (d) a double layer bag with a top opening having a top hem containing an elastic means, an outer wall and an inner wall with a gap between the walls, the double layer bag securely affixed to an outer side of the container by having the top hem of the bag detachably attached onto the top of the outer transverse ring of the container and retained thereon by the elastic means, the outer wall of the top ring cover shielding the top hem at the location where the double layer bag is retained on the outer transverse ring; (e) a multiplicity of granules retained within the gap between the outer and inner walls of the double layer bag to provide a squeezable feel to the double layer bag; and (f) the combination of the top ring cover and container being sized to retain a beverage container therein.

Defined most broadly, the present invention is a container holder comprising: (a) a top ring cover and a container, the top ring cover having an interior wall and an exterior wall both joined at a top circumference to form a round opening of the top ring cover; (b) the container having a first section and a second section with a retaining means located at the intersection of the two sections, the first section having a wall and the second section having a wall with a smaller diameter than the first section, the first and second sections forming an interior chamber with a bottom wall on the second section; (c) the top ring cover covers the interior chamber by having the top ring cover press fit onto the container so that the interior wall is press fit within the first cylindrical section of the container and is aligned with the wall of the second section; (d) a double layer bag with a top opening having a top hem containing an elastic means, an outer wall and an inner wall with a gap between the walls, the double layer bag securely affixed to an outer side of the container by having the top hem of the bag detachably attached onto the retaining means of the container and retained thereon by the elastic means, the outer wall of the top ring cover shielding the top hem at the location where the double layer bag is retained on the outer transverse ring; (e) a multiplicity of granules retained within the gap between the outer and inner walls of the double layer bag to provide a squeezable feel to the double layer bag; and (f) the combination of the top ring cover and container being sized to retain a beverage container therein.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A container holder comprising:

a. a top ring cover, a container, and a bottom ring attachment, the top ring cover having a top circumference with circular inner cylindrical wall extending to a bottom interior circumference and an outer curved declining outwardly extending wall extending from the top circumference to a bottom exterior circumference, the circular inner cylindrical wall and outer curved wall joined at a top circumference to form a round opening of said top ring cover;

b. said container is a generally a cylindrically shaped apparatus having a first cylindrical section and a second cylindrical section, said first cylindrical section having a top round opening extending to a transverse outer ring which connects to a top of the second cylindrical section which has a closed flat bottom, with a short height circular wall vertically affixed to an outer side of said bottom of the container;

c. said bottom planar ring attachment having a planar ring containing a central round opening, and a first and second short height circular wall which are vertically affixed onto the planar ring, said first and second short height wall are concentric and separated by a gap which matches a thickness of the circular wall on the bottom of the container;

d. said top ring cover covers said top round opening of the container, said bottom planar ring attachment is affixed to the bottom of the container by insertion of the short height circular wall of the container into the gap of the bottom planar ring attachment, which creates an air gap between the bottom of the container and a bottom surface of the bottom planar ring attachment;

e. a double layer bag with a top opening having a top hem containing an elastic means, an outer wall and an inner wall with a gap between the walls, said double layer bag securely affixed to an outer side of the container by having the top hem of the bag detachably attached onto the top of the outer transverse ring of the container and retained thereon by the elastic means, the outer curved wall of the top ring cover shielding the top hem at the location where the double layer bag is retained on the outer transverse ring;

f. the top ring cover press fit onto the container so that the circular inner cylindrical wall is press fit within the first cylindrical section of the container;

g. a multiplicity of granules retained within the gap between the outer and inner walls of the double layer bag to provide a squeezable feel to the double layer bag; and h. the combination of the top ring cover and container being sized to retain a beverage container therein.

2. The container in accordance with claim 1 wherein said granules are selected from the group comprising beans and sand.

3. The container in accordance with claim 1 wherein the inner and outer walls of the double layer bag extend to below the bottom planar ring attachment and the gap between the walls extends to below the bottom planar ring attachment with the gap area below the bottom planar ring attachment having a multiplicity of granules therein.

4. The container in accordance with claim 1 wherein said granules are comprised of material which can be heated to retain heat and can be frozen to retain cold.

5. A container holder comprising:

a. a top ring cover and a container, the top ring cover having a top circumference with circular inner cylindrical wall extending to a bottom interior circumference and an outer curved declining outwardly extending wall extending from the top circumference to a bottom exterior circumference, the circular inner cylindrical wall and outer curved wall joined at a top circumference to form a round opening of said top ring cover;

b. said container is a generally a cylindrically shaped apparatus having a first cylindrical section with a wall and a second cylindrical section with a wall and with a smaller diameter than the first cylindrical, said first cylindrical section having a top round opening extending to a transverse outer ring which connects to a top of the second cylindrical section which has a closed flat bottom;

c. said top ring cover covers said top round opening of the container by having the top ring cover press fit onto the container so that the circular inner cylindrical wall is press fit within the wall of first cylindrical section of the container and is aligned with the wall of the second cylindrical section;

d. a double layer bag with a top opening having a top hem containing an elastic means, an outer wall and an inner wall with a gap between the walls, said double layer bag securely affixed to an outer side of the container by having the top hem of the bag detachably attached onto the top of the outer transverse ring of the container and retained thereon by the elastic means, the outer curved wall of the top ring cover shielding the top hem at the location where the double layer bag is retained on the outer transverse ring;

e. a multiplicity of granules retained within the gap between the outer and inner walls of the double layer bag to provide a squeezable feel to the double layer bag; and f. the combination of the top ring cover and container being sized to retain a beverage container therein.

6. The container in accordance with claim 5 wherein said granules are selected from the group comprising beans and sand.

7. The container in accordance with claim 5 wherein the inner and outer walls of the double layer bag extend to below the bottom wall of the container and the gap between the walls extends to below the bottom wall of the container with the gap area below the bottom wall having a multiplicity of granules therein.

8. The container in accordance with claim 5 wherein said granules are comprised of material which can be heated to retain heat and can be frozen to retain cold.

9. A container holder comprising:

a. a top ring cover and a container, the top ring cover having an interior wall and an exterior wall both joined at a top circumference to form a round opening of said top ring cover;

b. said container is a generally cylindrically shaped apparatus having a first cylindrical section and a second cylindrical section, said first cylindrical section having a top round opening extending to a transverse outer ring which connects to a top of the second cylindrical section which has a closed flat bottom;

c. said top ring cover covers said top round opening of the container by having the top ring cover press fit onto the container so that the interior wall is press fit within the first cylindrical section of the container;

d. a double layer bag with a top opening having a top hem containing an elastic means, an outer wall and an inner wall with a gap between the walls, said double layer bag securely affixed to an outer side of the container by having the top hem of the bag detachably attached onto the top of the outer transverse ring of the container and retained thereon by the elastic means, the outer wall of the top ring cover shielding the top hem at the location where the double layer bag is retained on the outer transverse ring;

e. a multiplicity of granules retained within the gap between the outer and inner walls of the double layer bag to provide a squeezable feel to the double layer bag; and f. the combination of the top ring cover and container being sized to retain a beverage container therein.

10. The container in accordance with claim 9 wherein said granules are selected from the group comprising beans and sand.

11. The container in accordance with claim 9 wherein the inner and outer walls of the double layer bag extend to below the bottom wall of the container and the gap between the walls extends to below the bottom wall of the container with the gap area below the bottom wall having a multiplicity of granules therein.

12. The container in accordance with claim 9 wherein said granules are comprised of material which can be heated to retain heat and can be frozen to retain cold.

13. A container holder comprising:

a. a top ring cover and a container, the top ring cover having an interior wall and an exterior wall both joined at a top circumference to form a round opening of said top ring cover;

b. said container having a first section and a second section with a retaining means located at the intersection of the two sections, the first section having a wall and the second section having a wall with a smaller diameter than the first section, the first and second sections forming an interior chamber with a bottom wall on the second section;

c. said top ring cover covers said interior chamber by having the top ring cover press fit onto the container so that the interior wall is press fit within the first cylindrical section of the container and is aligned with the wall of the second section;

d. a double layer bag with a top opening having a top hem containing an elastic means, an outer wall and an inner wall with a gap between the walls, said double layer bag securely affixed to an outer side of the container by having the top hem of the bag detachably attached onto the retaining means of the container and retained thereon by the elastic means, the outer wall of the top ring cover shielding the top hem at the location where the double layer bag is retained on the outer transverse ring;

e. a multiplicity of granules retained within the gap between the outer and inner walls of the double layer bag to provide a squeezable feel to the double layer bag; and f. the combination of the top ring cover and container being sized to retain a beverage container therein.

14. The container in accordance with claim 13 wherein said granules are selected from the group comprising beans and sand.

15. The container in accordance with claim 13 wherein the inner and outer walls of the double layer bag extend to below the bottom wall of the container and the gap between the walls extends to below the bottom wall of the container with the gap area below the bottom wall having a multiplicity of granules therein.

16. The container in accordance with claim 13 wherein said granules are comprised of material which can be heated to retain heat and can be frozen to retain cold.

* * * * *